US006488728B1

(12) United States Patent
Rollinger

(10) Patent No.: US 6,488,728 B1
(45) Date of Patent: Dec. 3, 2002

(54) METHOD FOR THE DISPOSAL OF WASTE PRODUCTS CONTAINING HYDROCARBONS AND/OR HALOGENATED WASTE PRODUCTS

(75) Inventor: Guy Rollinger, Wickrange (LU)

(73) Assignee: Pac Holdings S.A., Wickrange (LU)

( * ) Notice: Subject to any disclaimer, the term of this patent is extended or adjusted under 35 U.S.C. 154(b) by 0 days.

(21) Appl. No.: 09/445,681

(22) PCT Filed: Jun. 12, 1998

(86) PCT No.: PCT/EP98/03566

§ 371 (c)(1),
(2), (4) Date: Dec. 10, 1999

(87) PCT Pub. No.: WO98/56871

PCT Pub. Date: Dec. 17, 1998

(30) Foreign Application Priority Data

Jun. 12, 1997 (LU) ..... 90079
Sep. 10, 1997 (LU) ..... 90135

(51) Int. Cl.[7] ..... C10J 3/02

(52) U.S. Cl. ..... 48/197 FM; 48/198.2; 48/92

(58) Field of Search ..... 48/197 FM, 198.2, 48/92; 208/404, 408; 508/201, 205, 206

(56) References Cited

U.S. PATENT DOCUMENTS

| | | | | | |
|---|---|---|---|---|---|
| 3,252,773 | A | | 5/1966 | Solomon et al. | 48/202 |
| 3,743,541 | A | * | 7/1973 | Lichte | 134/2 |
| 4,003,823 | A | * | 1/1977 | Baird et al. | 208/108 |
| 4,092,236 | A | * | 5/1978 | Heredy | 208/404 |
| 4,421,631 | A | * | 12/1983 | Ampaya et al. | 208/404 |
| 5,315,055 | A | | 5/1994 | Butcher, Jr. | 585/241 |
| 5,434,335 | A | * | 7/1995 | Brummond et al. | 588/201 |
| 5,449,438 | A | * | 9/1995 | Jagau et al. | 201/10 |
| 6,069,290 | A | * | 5/2000 | Wagner | 588/1 |
| 6,124,518 | A | * | 9/2000 | Rasmussen | 588/205 |

FOREIGN PATENT DOCUMENTS

EP 0 592 057 A1 4/1994

* cited by examiner

*Primary Examiner*—Marian C. Knode
*Assistant Examiner*—Basia Ridley
(74) *Attorney, Agent, or Firm*—Gary M. Nath; Todd L. Juneau; Joshua B. Goldberg

(57) ABSTRACT

The invention relates to a method for the disposal of waste products containing hydrocarbons and/or halogenated waste products, wherein the waste products are made to react in a hydroxide molten bath in the absence of oxygen at temperatures of 400–900° C.

12 Claims, 1 Drawing Sheet

Figure 1:
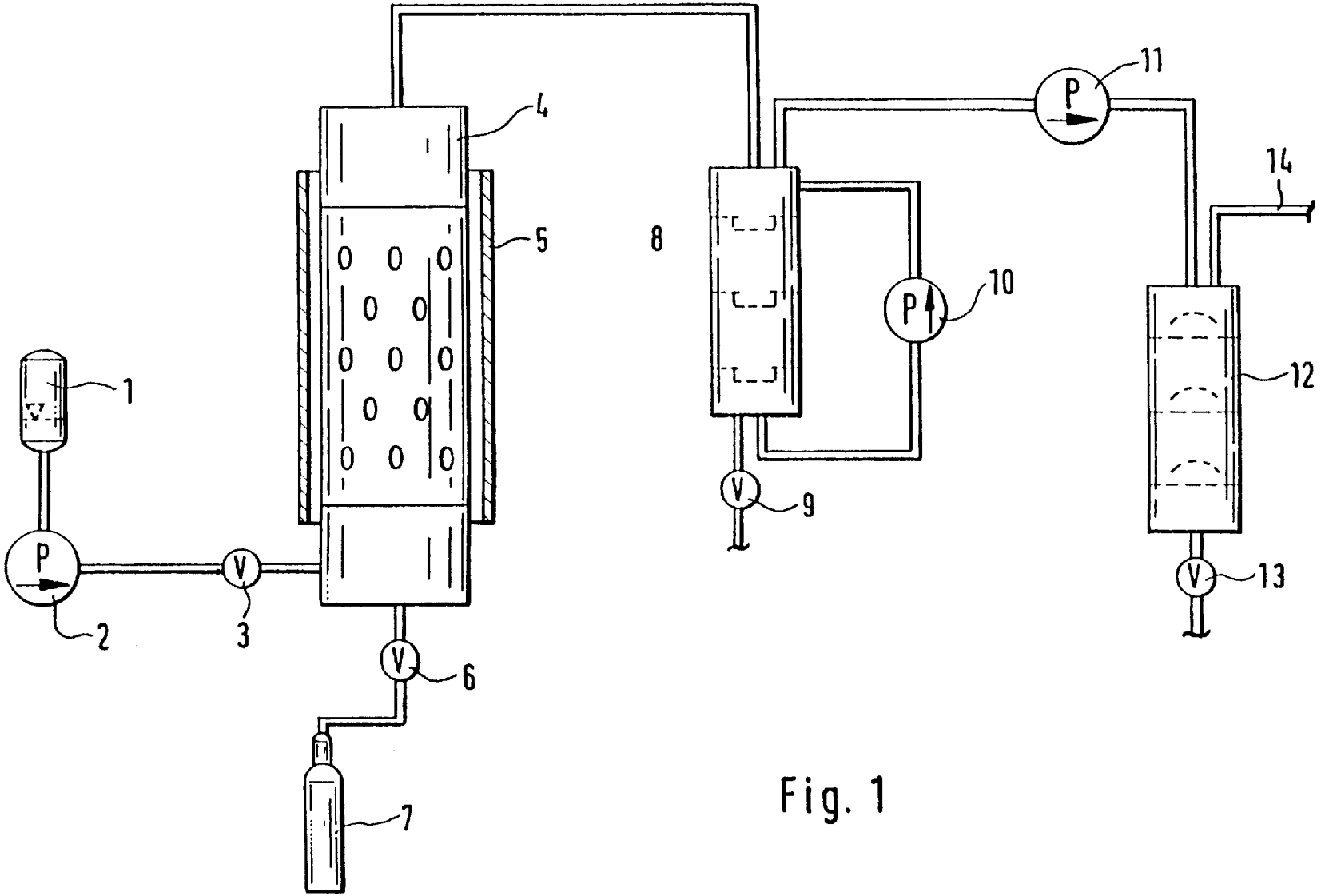

METHOD FOR THE DISPOSAL OF WASTE PRODUCTS CONTAINING HYDROCARBONS AND/OR HALOGENATED WASTE PRODUCTS

The present invention relates to a process for the disposal of hydrocarbon-containing and/or halogenated waste products.

It is known how to dispose of hydrocarbon-containing and/or halogenated waste products by incinerating them at high temperature in an open flame and utilizing the energy obtained from this.

Unfortunately, during the incineration of hydrocarbon-containing and/or halogenated waste products a large number of different reaction products are obtained which are questionable in varying degrees as regards their environmental compatibility.

EP-A-0 592 057 discloses a process for the pyrolysis of organic waste substances, preferably of used vehicle tyres, and an apparatus for carrying out the process. The pyrolysis takes place with the exclusion of air and water and is operated under reduced pressure, preferably in a metal bath, at an operating temperature of 450–550° C., preferably below 500° C.

There is known from US-A-3 252 773 a process for producing hydrogen-containing gas from carbon-containing solid, in which the carbon-containing solid, a copper-containing catalyst and water vapour are brought into contact with an alkali metal melt, under conditions in which hydrogen-rich gas is produced. This gas formation is carried out in a temperature range of 427 to 982° C.

The object of the present invention is to develop a process which makes it possible to dispose of various hydrocarbon-containing and/or halogenated waste products in an environmentally friendly manner.

This object is achieved according to the invention by a process for the disposal of hydrocarbon-containing and/or halogenated waste products in which the waste products are reacted with the exclusion of oxygen and humidity in a hydroxide melt at temperatures from 580 to 900° C.

In an advantageous embodiment of the process the hydroxide is selected from the group of the alkali hydroxides.

In a preferred manner the hydroxide is sodium hydroxide and/or potassium hydroxide.

In a specific embodiment variant of the process according to the invention the ratio between sodium hydroxide and potassium hydroxide lies between 1:0 and 1:10 and preferably amounts to 1:0.5.

In a preferred embodiment of the process there are formed mainly hydrogen, methane and carbonates and, if halogenated waste products have been used, additionally also metal chlorides.

In addition, metal hydrides can also be obtained during the process, and in certain. cases still further hydrocarbons.

The alkali hydride obtained requires careful handling, since it is extremely reactive.

In order to eliminate alkali hydrides from the gas, preferably an alkali hydroxide melt or else a hydrocarbon is used.

The alkali hydrides obtained can be used either for obtaining metals or for obtaining hydrogen. The alkali hydroxides thereby obtained can be returned into the process.

Whereas the formation of alkali metal compounds is promoted in the temperature range around 300° C.–500° C., the maximum for hydrogen obtainable in the gaseous state lies at about 580° C. to about 900° C.

There can be used as hydrocarbon-containing waste products solvents, tars, spent oils, lubricants, fats, paints, dyes, waxes and non-halogenated plastics such as polyethylene, polypropylene, polystyrenes, polycarbonates or rubber, and as halogenated waste substances solvents such as chloroform, methylene chloride, tetra- and trichloroethylene, tetrachloroethane, coolants and refrigerants (CFCs), PCBs, dioxins, furans, brake fluid, pesticides, fungicides and herbicides, halogenated plastics.

The melt can furthermore contain a catalyst which contains a metal oxide not reducible by sodium hydride and which, if possible, is resistant to sulphur and/or sulphur compounds.

The reaction substances are preferably chosen from materials which do not form metallates with alkali hydrides and if possible also do not form any metal carbonyls, or only to a small extent.

Various developments of the invention will now be described below by means of the attached figures, in which FIG. 1 shows a diagram of the plant for disposing of hydrocarbon-containing and/or halogenated waste products.

The hydrocarbon-containing and/or halogenated waste products are charged into a charging hopper 1 and then introduced into the reactor 4 by means of a pump 2 through a pipe which is provided with a shut-off valve 3. The reactor 54 comprises a heating element 5 and can be connected to a nitrogen supply 7 by a shut-off valve 6. After the hydrocarbon-containing and/or halogenated waste products have reacted with the melt contained in the reactor 4, the products are fed to a first gas scrubber 8, in which the solids are retained. The solids can then be removed via a discharge device 9. The scrubbing medium is circulated by a pump 10.

The gases liberated from the solids are then passed through a gas compressor 11 to a second scrubbing column 12, in which various gases can be scrubbed out. The solids formed can be discharged by means of a shut-off cock 13.

The gases purified in this way are led off through the upper part of the scrubbing column 12 through a pipe 14.

The following embodiments may be mentioned:

In a steel reactor the above-mentioned batch materials are reacted thermochemically in an alkali hydroxide melt consisting of 2 parts sodium hydroxide (NaOH) and one part potassium hydroxide (KOH) at temperatures of 750° C. to about 820° C. with exclusion of air and oxygen under atmospheric pressure, i.e. 1.013 bar±0.05 bar.

The reaction or conversion products preferably formed thermodynamically under these process parameters are primarily hydrogen ($H_2$) obtained in gaseous form together with smaller percentage amounts of methane ($CH_4$).

The formation of environmentally harmful or environmentally polluting gaseous substances such as carbon monoxide (CO), as well as the carbon dioxide ($CO_2$) known as so-called greenhouse gas, is negligibly small.

In addition to the gaseous substances hydrogen and methane primarily formed, there are formed as secondary substances various metal compounds based on the respective melt constituents.

As a rule these are essentially the alkali metals obtained as solid agglomerations (here: metallic sodium, metallic potassium), alkali metal carbonates (here: sodium carbonate, $Na_2CO_3$; potassium carbonate, $K_2CO_3$), as well as alkali metal hydrides (here: sodium hydride, NaH; potassium hydride, KH). These various alkali metal compounds can be obtained. by suitable separation methods and possess great commercial importance in some cases.

Thus the alkali metal hydrides can be reacted chemically with various metal oxides, metal chlorides and metal sulphides in such a way that pure or high-purity metals can be obtained as reaction products.

The uses of the primarily formed gases are just as various and multi-faceted as those for the secondary products. The main emphasis, here, however, is the obtaining of electrical energy by conversion of the product gases in gas engines and gas turbines and in fuel cells.

The process can however be modified in such a way that either greater amounts of alkali metal compounds can be produced or the yield in process gas is increased. This takes place mainly by the variation of the test temperature. Whereas the formation of alkali metal compounds is promoted in the temperature range around 300° C.–500° C. the maximum for hydrogen obtainable in the gaseous state lies at about 580° C. to about 900° C. At these higher temperatures the composition of the process gas shifts in the direction of hydrogen, which means that fewer portions of methane are contained in the process gas in percentage terms. At lower temperatures the amount of hydrogen lies below the achievable maximum. The composition of the gaseous constituents, here in particular hydrogen and methane, is different from the composition at approx. 800° C., namely such that greater amounts of methane are formed. A greater yield of hydrogen cannot be obtained at test temperatures beyond 900° C. since thermal decomposition processes increase. Moreover, the formation of environmentally dangerous emissions such as carbon monoxide and carbon dioxide, which are not formed under normal process conditions, is promoted, i.e. carbon and oxygen portions are promoted thermodynamically and stored as alkali metal carbonates.

At the start of a test the reactor (ST37 normal steel, 4 m height, 200–400 mm inner diameter) is charged with the alkali metal hydroxides via a gas-tight nozzle. Thereafter the contents are heated to a temperature of approx. 750° C. by means of an electric heating device (tubular heater or heating half-shells).

A homogeneous melt which possesses a melting point eutectic is formed.

The temperature measurement is conducted by means of an Ni—CrNi or Pt—PtRh thermocouple, which projects via a gas-tight nozzle into the centre of the reactor, so that the temperature of the melt can be read off there. On safety grounds and for the better intermixing of the melt, nitrogen is introduced into the melt first of all via special nozzles. The nitrogen mixes the melt thoroughly and at the same time expels any residual air contained in the plant.

After a certain run-up time a start can be made on introducing the various hydrocarbon-containing and/or halogenated waste products into the reactor. The introduction takes place via an eccentric screw pump which distributes the substances to be introduced from either one or several inlet systems. The use of several substance inlet systems permits the capacity of the reactor to be raised.

Due to the high temperatures on the one hand and the aggressive, alkaline milieu of the reactor melt on the other, the various batch materials are broken down. In so doing, the decomposition products react to form new products, which are initially gaseous because of the temperature. There are obtained during the reaction in the main large amounts of hydrogen and methane.

Alkali metals, alkali metal carbonates, alkali metal hydrides and alkali metal chlorides are obtained as further, secondary products. These substances form at slightly lower temperatures, so that they crystallize on cooling and can be retained in a scrubbing column flushed continuously with paraffin oil. There remain in the reactor itself the unconverted alkali metal hydroxides together with a portion of the alkali metal carbonates and the alkali metal chlorides.

A slight excess pressure of about 0.05 bar above normal pressure, based on the corresponding partial pressures of the gases obtained, is produced by the reaction.

The gases liberated from the solid constituents are sucked in by a side channel compressor and purified in a further scrubbing column.

This second scrubbing column contains a zinc sulphate solution ($ZnSO_4$). If sulphur constituents are contained in the various batch materials, hydrogen sulphide ($H_2S$) is formed in the reactor. This substance should be removed from the gases obtained not least because of its toxicity and the smell. This is done by means of a chemical precipitation reaction in the second gas scrubbing column. During the gas scrubbing zinc sulphide (ZnS) is formed, which occurs as a crystalline material that sinks to the bottom of the scrubbing column and can be separated there by means of a discharge mechanism. Sulphuric acid ($H_2SO_4$) is precipitated as a further by-product of the gas scrubbing. This fact permits, through a continuous checking of the pH value of the scrubbing liquid, a conclusion to be drawn as to the content of hydrogen sulphide formed.

The hydrogen and methane obtained are not affected by the gas scrubbing with the zinc sulphate solution and can be used-for obtaining energy as intended.

Temperature, pressure and leakage measuring instruments should be used as safety measures. In the event of a leak in the system there is the risk of reactions (reaction equations 1–3) which make the process difficult to control. The following reactions are the most important ones here:

a) conversion of alkali metals with humidity, for example sodium $$2\ Na + 2\ H_2O = 2\ NaOH + H_2 + \text{energy} \qquad \text{(reaction equation 1)}$$

b) conversion of alkali metal hydrides with humidity, for example sodium hydride $$2\ NaH + 2\ H_2O = 2\ NaOH + 2H_2 + \text{energy} \qquad \text{(reaction equation 2)}$$

c)

$$2\ H_2 + O_2 = 2H_2O + \text{energy} \qquad \text{(reaction equation 3)}$$

For this reason it is important that suitable seals, such as metal jacketed ceramic seals, pressure relief devices and in particular leak indicators, for example, be installed.

The substances remaining behind in the reactor, as well as unconverted metal hydroxides, can be removed from the system either discontinuously or continuously. There takes place in the simplest manner an emptying of the reactor and the reactor bottom, which should be happening roughly as follows: In the reactor bottom a circular cut-out is provided, which leads into a heated discharge pipe.

This pipe is provided above a collecting trough with a special thread and screwed gas-tight. If the reactor contents are now to be drained from the reactor, the screw connection is loosened and the pipe is heated by means of a heating coil to about 250° C. The melt, which had run into the discharge pipe beforehand and congealed there, becomes fluid again. The "natural plug" is thus loosened and the reactor contents can flow into the collecting trough and cool down there without risk.

EXAMPLE 1

In a test motor oil was reacted at a temperature of 743° C. and a pressure of 1.05 bar according to the method described above.

A gas sample (sample 1) was taken during the method and tested for $CO_2$, $O_2$, CO, $H_2$, $CH_4$, $C_2H_6$, $C_2H_4$ and $C_3H_8$. The individual components of the gas samples were determined as follows:

$CO_2$, CO, $CH_4$ infra-red spectroscopically by means of URAS[1] gas analyser $H_2$, alkanes gas chromatographic separation and detection by means of heat conduction detector (HCD).

The investigation of the gas samples had the following results

| Compound | Sample 1 % |
|---|---|
| $CO_2$ | 0.02 |
| $O_2$ | 0.76 |
| CO | 1 ppm |
| $H_2$ | 90 |
| $CH_4$ | 5.6 |
| $C_2H_6$ | 0.17 |
| $C_2H_4$ | 0.01 |
| $C_3H_8$ | 0.02 |

[1]URAS = Ultra-red absorption recorder

EXAMPLE 2

In a further test spent oil (A) was reacted at a temperature of 758° C. and a pressure of 1.05 bar and a mixture (B) of spent oil and paint at 762° C. and a pressure of 1.06 bar by the method described above.

One gas sample respectively (sample 3 (A) and sample 4 (B)) was taken during the process and tested for $N_2$, $CO_2$, $O_2$, CO, $H_2$, $CH_4$ and $C_2H_8$.

In this case the samples were analysed by means of gas chromatography, combined with a flame ionisation detector.

The investigation of the gas samples had the following results

| Compound | Sample 3 Vol. % | Sample 4 Vol. % |
|---|---|---|
| $N_2$ (carrier gas) | 12.0 | 12.2 |
| $CO_2$ | <0.5 | <0.5 |
| $O_2$ | <0.5 | <0.5 |
| CO | <0.5 | <0.5 |
| *$H_2$ | 66.0 | 77.0 |
| $CH_4$ | 20.5 | 9.9 |
| $C_2H_8$. | 1.5 | 0.9 |

* The hydrogen content was not determined directly, but calculated by difference from 100 vol. %.

The accuracy of the analysis is ±5 vol. % relative.

EXAMPLE 3

In further tests a mixture of motor oil and paint (mixture C) and used deep-fry oil (mixture D) was reacted according to the method described above under the following conditions:

| Mixture | Temperature (° C.) | Pressure (bar) |
|---|---|---|
| C (motor oil and paint) | 755 | 1.05 |
| D (used deep-fry oil) | 765 | 1.07 |

One gas sample respectively (samples C, D, E, F, G, correspond to the various mixtures) was taken during the method and tested for $CO_2$, $O_2$, CO, $H_2$, $CH_4$, $C_2H_6$, $C_2H_4$, $C_3H_8$ and $C_2H_8$ and $C_2H_2$. The individual components were determined as under Example 1:

The testing of the gas samples had the following results:

| Compound | Sample C vol. % | Sample D vol. % |
|---|---|---|
| $CO_2$ | 0.00 | 0.01 |
| $O_2$ | 0.72 | 1.07 |
| CO | 0.0001 | 0.0001 |
| $H_2$ | 86.3 | 81.6 |
| $CH_4$ | 11.5 | 14.7 |
| $C_2H_6$ | 0.26 | 0.53 |
| $C_2H_4$ | 0.01 | Traces |
| $C_3H_8$ | 0.02 | 0.03 |
| $C_2H_2$ | 0.01 | 0.05 |

EXAMPLE 4

In a test 1,1,1-trichloroethane was reacted at a temperature of 786° C. and a pressure of 1.013 bar ±0.06 bar according to the method described above.

One gas sample (sample 5) was taken during the procedure and tested for carbon, oxygen, nitrogen, carbon monoxide, hydrogen, methane, ethane, ethylene, propane, propylene, n-butane, i-butane, n-butylene, i-butylene, acetylene, chlorinated paraffins, benzene, toluene and xylene.

The investigation of the gas samples had the following results.

| Compound | Sample 5 | Unit |
|---|---|---|
| Carbon | 0.01 | vol. % |
| Oxygen | 0.6 | vol. % |
| Nitrogen | not reported | vol. % |
| Carbon monoxide | 0.0003 | vol. % |
| Hydrogen | 90.3 | vol. % |
| Methane | 5.6 | vol. % |
| Ethane | 0.23 | vol. % |
| Ethylene | 0.08 | vol. % |
| Propane | 0.013 | vol. % |
| Propylene | not detected | vol. % |
| n-butane | not detected | vol. % |
| i-butane | not detected | vol. % |
| n-butylene | not detected | vol. % |
| i-butylene | not detected | vol. % |
| acetylene | 0.2 | vol. % |
| chlorinated paraffins | <1.0 | $mg/m^3$ |
| benzene | 72.9 | $mg/m^3$ |
| toluene | 6.27 | $mg/m^3$ |
| xylene | 0.93 | $mg/m^3$ |

What is claimed is:

1. Method for disposing of hydrocarbon-containing and/or halogenated waste products, in which the waste products are reacted without oxygen and humidity in a hydroxide melt, said hydroxide melt having a temperature from about 580 C. to about 900 C. at about atmospheric pressure, wherein said method produces a product stream containing at least 66 vol. % gaseous hydrogen.

2. Method according to claim 1, characterised in that the hydroxide melt is selected from the group of alkali hydroxides.

3. Method according to claim 2, characterised in that the hydroxide melt is sodium hydroxide and/or potassium hydroxide.

4. Method according to claim 3, characterised in that the sodium hydroxide and the potassium hydroxide have a ratio between 1:0 and 1:10.

5. Method according to claim 4, characterised in that the ratio between the sodium hydroxide and the potassium hydroxide is 1:0.5.

6. Method according to claim 1, characterized in that there are formed in the method mainly hydrogen, methane, carbonates, and, if the halogenated waste products have been used, additionally also metal chlorides.

7. Method according to claim 1, characterised in that an amount of hydride is obtained in the method.

8. Method according to claim 1, wherein the waste products are selected from the group consisting of hydrocarbon-containing waste substances, non-halogenated plastics, halogenated waste substances, and solvents.

9. The method of claim 8, wherein the hydrocarbon-containing waste substances are selected from the group consisting of spent oils, lubricants, fats, paints, dyes, tars, and waxes.

10. The method of claim 8, wherein the non-halogenated plastics are selected from the group consisting of polyethylene, polypropylene, polystyrenes and rubber.

11. The method of claim 8, wherein the halogenated waste substances are selected from the group consisting of coolants and refrigerants (CFCs), PCBs, dioxins, furans, brake fluid, pesticides, fungicides, herbicides, and halogenated plastics.

12. The method of claim 8, wherein the solvents are selected from the group consisting of chloroform, methylene chloride, tetra- and trichloro-ethylene, and tetrachloroethane.

* * * * *